US007777133B2

(12) United States Patent
Onuma

(10) Patent No.: US 7,777,133 B2
(45) Date of Patent: Aug. 17, 2010

(54) JOINT STRUCTURE OF COPPER WIRE AND ALUMINUM WIRE, AND JOINT METHOD

(75) Inventor: Masanori Onuma, Makinohara (JP)

(73) Assignee: Yazaki Corporation, Tokyo (JP)

( * ) Notice: Subject to any disclaimer, the term of this patent is extended or adjusted under 35 U.S.C. 154(b) by 118 days.

(21) Appl. No.: 12/260,209

(22) Filed: Oct. 29, 2008

(65) Prior Publication Data

US 2009/0133927 A1 May 28, 2009

(30) Foreign Application Priority Data

Nov. 27, 2007 (JP) ..... 2007-305696

(51) Int. Cl.
*H01R 4/18* (2006.01)

(52) U.S. Cl. ..... 174/84 C

(58) Field of Classification Search ..... 174/84 C, 174/94 R

See application file for complete search history.

(56) References Cited

U.S. PATENT DOCUMENTS 3,878,318 A * 4/1975 Ziegler et al. ..... 174/94 R 7,282,679 B2 * 10/2007 Reichinger ..... 219/541

FOREIGN PATENT DOCUMENTS

JP 9-180848 A 7/1997

* cited by examiner

*Primary Examiner*—Chau N Nguyen
(74) *Attorney, Agent, or Firm*—Sughrue Mion, PLLC

(57) ABSTRACT

A joint structure of electric wires includes: a copper wire which includes a conductor formed of copper; an aluminum wire which includes a conductor formed of aluminum or aluminum alloy; and a joint terminal provided with a conductor press-fitting part having a U-shape in cross section. The conductor press-fitting part includes a bottom plate and a pair of conductor caulking pieces which are upwardly extended from both side edges of the bottom plate, and is inwardly folded to caulk the conductors of the copper wires and the aluminum wires so as to enclose the conductors. The conductor press-fitting part is press-fitted to the conductors of the aluminum wire and the copper wire in a state that the conductor of the aluminum wire is disposed on the upper face of the bottom plate, and the conductor of the copper wire is disposed on the conductor of the aluminum wire.

8 Claims, 1 Drawing Sheet

JOINT STRUCTURE OF COPPER WIRE AND ALUMINUM WIRE, AND JOINT METHOD

BACKGROUND OF THE INVENTION

1. Technical Field

The present invention relates to a joint structure in which a copper wire and an aluminum wire are electrically connected to each other by means of a joint terminal, and a joint method for obtaining the joint structure.

2. Background Art

The joint terminal has been used for direct connection between electric wires (For example, see JP-A-9-180848). The joint terminal is a terminal having a U-shape in cross section, which includes a bottom plate, and a pair of conductor caulking pieces provided upright at both side edges of the bottom plate and adapted to be folded inwardly so as to enclose conductors of the electric wires to be connected thereby to caulk the conductors in tight contact with an upper face of the bottom plate.

In case of connecting two covered wires by means of this joint terminal, two conductors (each of the conductors includes a bundle of a plurality of raw wires in a form of twisted wires) which are exposed by stripping coverings are superposed on the bottom plate of the joint terminal, and in this state, a pair of the conductor caulking pieces are folded inwardly and caulked by means of a caulking tool having an upper mold and a lower mold (in other words, a press-fitting tool) so as to enclose the two conductors, whereby the two electric wires are connected.

In a wire harness to be arranged inside a vehicle such as an automobile, copper wires have been generally used. Since it has been difficult to use aluminum wires which are inferior in property such as electrical conductivity, strength, etc. (physical properties), the aluminum wires have been scarcely used. However, in recent years, use of the aluminum wires has been more and more required in consideration of weight reduction of the vehicle, a resulting low fuel cost, and recycling performance.

In case of using the aluminum wire, it is necessary to joint the copper wire and the aluminum wire. For example, it is a main stream that the known electric component such as a connector is produced on the premise that the copper wire is used, and therefore, when the aluminum wire is used, there is such anxiety the same component cannot be used because of differences in size, and so on. Under the circumstances, when the known electric component is used as it is, it is considered that the copper wire is used in a part directly connected to the electric component, while the aluminum wire is used in other parts. In this case, it is necessary to elaborate a structure for jointing the aluminum wire and the copper wire on halfway.

However, joint of the copper wire and the aluminum wire by means of a joint terminal has not been heretofore conducted, and for realizing such joint, both the problem of strength and the problem of electric performance must be cleared. In case where the copper wire and the aluminum wire are actually connected by means of the joint terminal, differences in physical properties such as strength, electrical conductivity must be taken into consideration. At the same time, presence of oxidation layer on the conductor formed of aluminum or aluminum alloy must be fully considered, but not sufficiently considered at present.

SUMMARY OF THE INVENTION

The invention has been made in view of the above described circumstances, and it is an object of the invention to provide a joint structure which can connect a copper wire and an aluminum wire to each other, while mechanical strength and performance of electrical connection are fully satisfied, and can exert high connecting performance, and a joint method for obtaining the joint structure.

In order to attain the above described object, a joint structure of a copper wire and an aluminum wire according to the invention is characterized in the following structures (1) to (3).

(1) A joint structure of electric wires, including:

a copper wire which includes a conductor formed of copper;

an aluminum wire which includes a conductor formed of aluminum or aluminum alloy; and a joint terminal provided with a conductor press-fitting part having a U-shape in cross section, the conductor press-fitting part including: a bottom plate; and a pair of conductor caulking pieces which are upwardly extended from both side edges of the bottom plate, and is inwardly folded to caulk the conductors of the copper wires and the aluminum wires so as to enclose the conductors to be connected to each other, wherein the conductor press-fitting part is press-fitted to the conductor of the aluminum wire and the conductor of the copper wire in a state that the conductor of the aluminum wire is disposed on the upper face of the bottom plate, and the conductor of the copper wire is disposed on the conductor of the aluminum wire.

(2) The joint structure according to (1), wherein an outside diameter of the conductor of the aluminum wire is set to be larger than an outside diameter of the conductor of the copper wire.

(3) The joint structure according to (1) or (2), wherein serrations are formed on inner face, involving the upper face of the bottom plate, of the conductor press-fitting part which is press-fitted to the conductor of the aluminum wire.

Moreover, in order to attain the above described object, a joint method of a copper wire and an aluminum wire according to the invention is characterized in the following structures (4) to (6).

(4) A joint method of electric wires, including:

providing a copper wire which includes a conductor formed of copper; an aluminum wire which includes a conductor formed of aluminum or aluminum alloy; and a joint terminal provided with a conductor press-fitting part having a U-shape in cross section, the conductor press-fitting part including: a bottom plate; and a pair of conductor caulking pieces which are upwardly extended from both side edges of the bottom plate, and is inwardly folded to caulk the conductors of the copper wires and the aluminum wires so as to enclose the conductors to be connected to each other, placing the conductors of the aluminum wire and the copper wire in the joint terminal so as to dispose the conductor of the aluminum wire below the conductor of the copper wire;

inwardly folding the pair of the conductor caulking pieces to caulk the conductors of the copper wires and the aluminum wires so as to enclose the conductors; and press-fitting the press-fitting part of the joint terminal to the conductor of the aluminum wire and the conductor of the copper wire in a state that the conductor of the aluminum wire is disposed on the upper face of the bottom plate, and the conductor of the copper wire is disposed on the conductor of the aluminum wire.

(5) The joint method according to (4), wherein an outside diameter of the conductor of the aluminum wire is set to be larger than an outside diameter of the conductor of the copper wire.

(6) The joint method according to (4) or (5), wherein serrations are formed on inner face, involving the upper face of the bottom plate, of the conductor press-fitting part which is press-fitted to the conductor of the aluminum wire.

According to the joint structure or joint method having the configurations of the above item (1) or (4), it is possible to connect the copper wire and the aluminum wire to each other, while satisfying both the mechanical performance and the electrical performance. Explanation will be made in this respect.

First, in case where the copper wire and the aluminum wire are compared in respect of their performances, the conductor formed of copper has larger mechanical strength and higher conductivity, as compared with the conductor formed of aluminum or aluminum alloy. On the contrary, the conductor formed of aluminum or aluminum alloy has smaller mechanical strength and lower conductivity, as compared with the conductor formed of copper. Additionally, an oxidation layer having high specific resistance is usually formed on a surface of the conductor formed of aluminum or aluminum alloy. Therefore, on occasion of press-fitting, contact and continuity between the conductors (the joint terminal and the conductor formed of aluminum or aluminum alloy) must be attained, while destroying the oxidation layer.

For example, let us consider a case where the connection by caulking is conducted without restricting positional relation between the copper wire and the aluminum wire, and the conductor formed of copper is placed on the bottom plate of the joint terminal and the conductor formed of aluminum or aluminum alloy is placed thereon. In this case, edges of tip ends of the conductor caulking pieces may bite the conductor formed of aluminum or aluminum alloy having the smaller strength, and hence, there is such possibility that the conductor formed of aluminum or aluminum alloy may be damaged, and fixing force may be decreased.

Moreover, it has been generally known that when the conductor caulking pieces of the joint terminal are caulked to the conductors for the purpose of press-fitting the conductors, contact pressure by caulking is lowered in a region of the joint terminal at an opposite side to the bottom plate (an upper region). In case where the conductor formed of aluminum or aluminum alloy is positioned in the region at the opposite side to the bottom plate where the contact pressure is low, there is such possibility that destroying action of the oxidation layer is not sufficient, and contact resistance is increased.

In this respect, in the structure as described in the above item (1) or (4), the conductor formed of copper is positioned in the region where damage by press-fitting is liable to increase, that is, the upper region of the joint terminal (the region at the opposite side to the bottom plate), while the conductor formed of aluminum or aluminum alloy is positioned in the lower region (at the side of the bottom plate), thereby to conduct press-fitting. Accordingly, it is possible to resist against the bites of the tip ends of the conductor caulking pieces with the conductor formed of copper having the larger strength. At the same time, it is possible to enhance removing effect of the oxidation layer on the surface of the conductor formed of aluminum or aluminum alloy, because the conductor formed of aluminum or aluminum alloy is positioned in the region having high contact pressure. As the results, it is possible to enhance fixing force of the two electric wires by caulking with the joint terminal, and at the same time, electrically favorable connection can be obtained.

According to the joint structure or joint method having the configurations of the above item (2) or (5), a connected state with stability can be obtained. Specifically, when electrical conductivities of aluminum and copper are compared, the electrical conductivity of aluminum is only about 60% of that of copper. Similarly, electrical conductivity of aluminum alloy is considerably lower than that of copper. Therefore, for the purpose of securing the same allowable value of electric current, the conductor formed of aluminum or aluminum alloy must be larger in diameter than the conductor formed of copper. In case where the conductor formed of aluminum or aluminum alloy is made larger in diameter, the conductor formed of aluminum or aluminum alloy tends to extensively spread in a region from the upper face of the bottom plate of the joint terminal to lower parts of the inner faces of the conductor caulking pieces, and contact area between the joint terminal and the conductor formed of aluminum or aluminum alloy tends to be enlarged. As the results, destroying efficiency of the oxidation layer is enhanced, and an electrically connected state with stability can be obtained. Moreover, it is possible to perform well balanced connection of the electric wires in respect of the allowable current value.

According to the joint structure or joint method having the configurations of the above item (3) or (6), since the serrations are provided on the inner face of the conductor press-fitting part to be press-fitted to the aluminum wire, the conductor formed of aluminum or aluminum alloy spreads starting from the serrations, and then the oxidation layer will be efficiently destroyed. As the results, electrically favorable connection can be obtained.

According to the invention, it is possible to enhance the fixing force of the electric wires by caulking with the joint terminal, and at the same time, the electrically favorable connection can be obtained.

Further, the invention is favorably used for achieving weight reduction of a vehicle and a resulting low fuel cost, and the invention is also favorably used in respect of recycling.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Figure 1A:
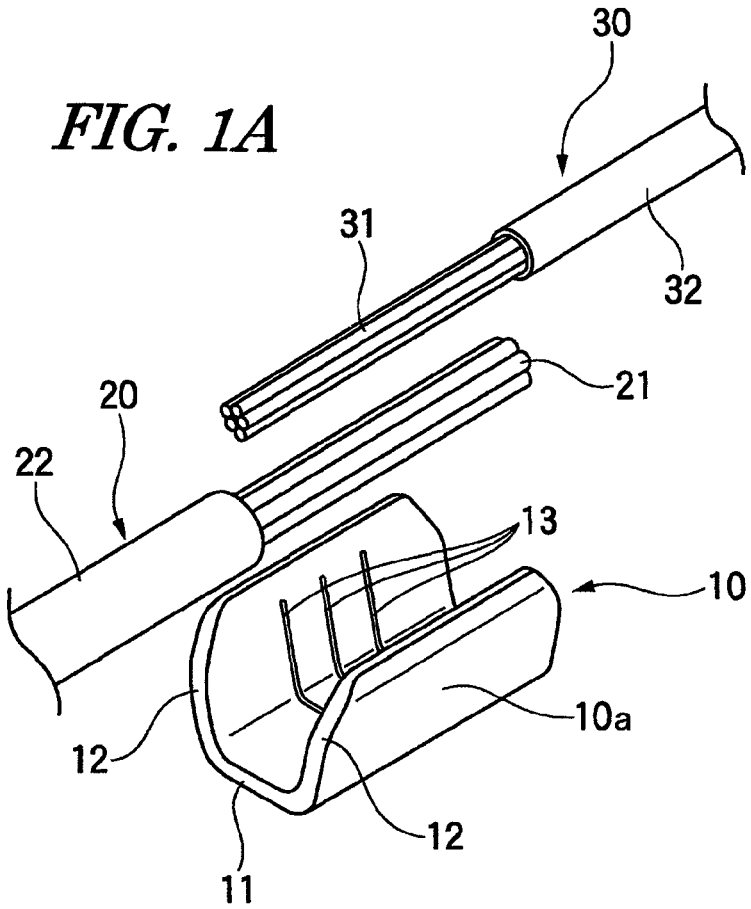
FIG. 1A is a view showing a state of setting an aluminum wire and a copper wire in a joint terminal according to an embodiment of the present invention.

Now, a preferred embodiment according to the invention will be described in detail referring to the drawings.

Figure 1B:
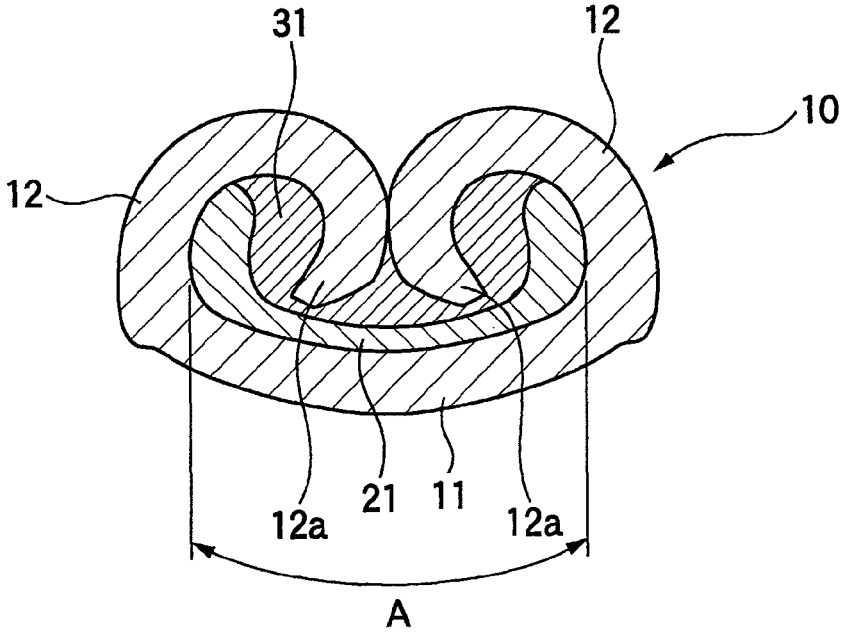
FIG. 1B is a sectional view of a joint part after caulked.

FIGS. 1A and 1B are explanatory views of a joint structure and a joint method in the embodiment, in which FIG. 1A is a view showing a state of setting an aluminum wire and a copper wire in a joint terminal, and FIG. 1B is a sectional view of a joint part after caulked.

A joint terminal 10 used in this embodiment is a terminal provided with a conductor press-fitting part 10*a* having a U-shape in cross section, which includes a bottom plate 11 and a pair of conductor caulking pieces 12 which are upwardly extended from both side edges of the bottom plate 11, and is inwardly folded to caulk the conductors in tight contact with an upper face of the bottom plate 11 so as to enclose conductors of the electric wires to be connected. Three serrations (that is, shallow grooves formed by stamping) extending in a direction perpendicular to a longitudinal direction of the joint terminal 10 are formed on the upper face of the bottom plate 11 and inner faces of a pair of the conductor caulking pieces 12 except respective tip end parts thereof. Of course, the number of serrations can be arbitrarily changed.

When a copper wire 30 and an aluminum wire 20 are connected to each other by means of this joint terminal 10, as a first step, insulating coverings 22, 32 in terminal end parts of the copper wire 30 and the aluminum wire 20 are removed thereby to expose a conductor 21 formed of aluminum (that is, a conductor including a bundle of a plurality of raw wires which are formed of aluminum in a form of twisted wires) and a conductor 31 formed of copper (that is, a conductor including a bundle of a plurality of raw wires which are formed of copper in a form of twisted wires) by a required length, as shown in FIG. 1A. Then, in a state where the aluminum wire 20 is extended to one side and the copper wire 30 is extended to the other side, the conductor 21 formed of aluminum and the conductor 31 formed of copper are superposed on each other on the bottom plate 11 of the joint terminal 10, in such a manner that the conductor 21 of the aluminum wire 20 formed of aluminum may be placed underneath the conductor 31 of the copper wire 30 formed of copper. In this embodiment, the aluminum wire 20 having the conductor 21 formed of aluminum which has a larger outside diameter than the conductor 31 of the copper wire 30 formed of copper is used.

Then, the joint terminal 10 having the two electric wires 20 and 30 superposed thereon is set on a caulking tool (not shown) so as to be worked, and a pair of the conductor caulking pieces 12 are folded inwardly so as to enclose the conductor 21 formed of aluminum and the conductor 31 formed of copper and caulked, as shown in FIG. 1B, thereby to electrically connect the copper wire 30 and the aluminum wire 20 to each other.

In case of caulking the two wires as described above, a joint structure in which the conductor 21 formed of aluminum is disposed on the bottom plate 11 of the joint terminal 10, and the conductor 31 formed of copper is disposed on the conductor 21 formed of aluminum is obtained, and in this state, the conductor press-fitting part 10*a* is press-fitted to the conductor 21 formed of aluminum and the conductor 31 formed of copper. As the results, the copper wire 30 and the aluminum wire 20 are reliably connected to each other, while the mechanical strength and electrical performance are satisfied.

Explanation will be made in detail. First, in case where properties of the conductor 21 formed of aluminum and the conductor 31 formed of copper are compared, the conductor 31 formed of copper has larger mechanical strength and higher electrical conductivity, as compared with the conductor 21 formed of aluminum. On the contrary, the conductor 21 formed of aluminum has smaller mechanical strength and lower electrical conductivity, as compared with the conductor 31 formed of copper. Additionally, an oxidation layer having high specific resistance is usually formed on a surface of the conductor 21 formed of aluminum. Therefore, on occasion of press-fitting, contact and continuity between the conductors (the joint terminal 10 and the conductor 21 formed of aluminum) must be attained, while destroying the oxidation layer.

For example, let us consider a case where the caulking is conducted without restricting positional relation between the copper wire 30 and the aluminum wire 20, particularly the case where the caulking is conducted in a state where the conductor formed of copper is placed on the bottom plate 11 of the joint terminal 10 and the conductor formed of aluminum is placed thereon. In this case, edges of tip ends 12*a* of the conductor caulking pieces 12 may bite the conductor formed of aluminum having the smaller strength, and hence, there is such possibility that the conductor formed of aluminum may be damaged, and fixing force may be decreased.

Moreover, it has been generally known that when the conductor caulking pieces 12 of the joint terminal 10 are caulked to the conductors for the purpose of press-fitting the conductors, contact pressure by caulking is lowered in a region of the joint terminal 10 at an opposite side to the bottom plate 11 (an upper region). In case where the conductor formed of aluminum is positioned in the region at the opposite side to the bottom plate 11 where the contact pressure is lowered, there is such possibility that destroying action of the oxidation layer is not sufficient, and contact resistance is increased.

However, in this embodiment, as shown in FIG. 1B, press-fitting by caulking the conductor caulking pieces 12 is conducted, in the state where the conductor 31 formed of copper is positioned in the region where the damage by press-fitting is liable to increase, that is, the upper region of the joint terminal 10 (the region at the opposite side to the bottom plate 11), while the conductor 21 formed of aluminum is positioned in the lower region (at the side of the bottom plate 11). Accordingly, it is possible to resist against the bites of the tip ends of the conductor caulking pieces 12 with the conductor 31 formed of copper having the larger strength, and at the same time, it is possible to enhance removing effect of the oxidation layer on the surface of the conductor 21 formed of aluminum, because the conductor 21 formed of aluminum is positioned in the region having high contact pressure (a region defined by an arrow A). As the results, it is possible to enhance fixing force of the two electric wires 20, 30 by caulking with the joint terminal 10, and at the same time, the electrically favorable connection can be obtained.

Moreover, comparing electrical conductivities of aluminum and copper, the electrical conductivity of aluminum is only about 60% of that of copper. Therefore, for the purpose of securing the same allowable value of electric current, the conductor formed of aluminum must be larger in diameter than the conductor formed of copper. In case where the conductor 21 formed of aluminum is made larger in diameter than the conductor 31 formed of copper, as in this embodiment, it is possible to extensively spread the conductor 21 formed of aluminum in the region from the upper face of the bottom plate 11 to the lower parts of the inner faces of the conductor caulking pieces 12, thus enabling contact area between the joint terminal 10 and the conductor 21 formed of aluminum to be enlarged. As the results, destroying efficiency of the oxidation layer is enhanced, and the connected state with stability can be obtained. Moreover, it is possible to perform well balanced connection of the electric wires in respect of the allowable current value.

Further, because the joint terminal 10 provided with the serrations 13 on the inner face thereof is used for conducting the press-fitting, it is possible to efficiently destroy the oxidation layer, by spreading the conductor 21 formed of aluminum starting from the serrations 13. As the results, the connected state electrically favorable can be obtained.

It is to be noted that the invention is not limited to the above described embodiment, but modifications and improvements and so on can be appropriately made. Further, materials, shapes, sizes, numbers, positions to be arranged, and so on of constituent elements in the above described embodiment are not limited, but can be optionally selected, provided that they can accomplish the invention.

For example, in case where the conductor 21 of the aluminum wire 20 is formed of aluminum alloy, the invention can be also carried out in the same manner as described above, and the same operation and effects as described above can be attained. As a specific example of the aluminum alloy, an alloy of aluminum and iron can be recommended. In case where this alloy is employed, the conductor can be easily stretched as compared with the conductor formed of aluminum, and the strength (particularly, a tensile strength) of the conductor can be increased.

What is claimed is:

1. A joint structure of electric wires, comprising:

a copper wire which includes a conductor formed of copper;

an aluminum wire which includes a conductor formed of aluminum or aluminum alloy; and a joint terminal provided with a conductor press-fitting part having a U-shape in cross section, the conductor press-fitting part including: a bottom plate; and a pair of conductor caulking pieces which are upwardly extended from both side edges of the bottom plate, and is inwardly folded to caulk the conductors of the copper wires and the aluminum wires so as to enclose the conductors to be connected to each other, wherein the conductor press-fitting part is press-fitted to the conductor of the aluminum wire and the conductor of the copper wire in a state that the conductor of the aluminum wire is disposed on the upper face of the bottom plate, and the conductor of the copper wire is disposed on the conductor of the aluminum wire.

2. The joint structure as claimed in claim 1, wherein an outside diameter of the conductor of the aluminum wire is set to be larger than an outside diameter of the conductor of the copper wire.

3. The joint structure as claimed in claim 2, wherein serrations are formed on inner face, involving the upper face of the bottom plate, of the conductor press-fitting part which is press-fitted to the conductor of the aluminum wire.

4. The joint structure as claimed in claim 1, wherein serrations are formed on inner face, involving the upper face of the bottom plate, of the conductor press-fitting part which is press-fitted to the conductor of the aluminum wire.

5. A joint method of electric wires, comprising:

providing a copper wire which includes a conductor formed of copper; an aluminum wire which includes a conductor formed of aluminum or aluminum alloy; and a joint terminal provided with a conductor press-fitting part having a U-shape in cross section, the conductor press-fitting part including: a bottom plate; and a pair of conductor caulking pieces which are upwardly extended from both side edges of the bottom plate, and is inwardly folded to caulk the conductors of the copper wires and the aluminum wires so as to enclose the conductors to be connected to each other, placing the conductors of the aluminum wire and the copper wire in the joint terminal so as to dispose the conductor of the aluminum wire below the conductor of the copper wire;

inwardly folding the pair of the conductor caulking pieces to caulk the conductors of the copper wires and the aluminum wires so as to enclose the conductors; and press-fitting the press-fitting part of the joint terminal to the conductor of the aluminum wire and the conductor of the copper wire in a state that the conductor of the aluminum wire is disposed on the upper face of the bottom plate, and the conductor of the copper wire is disposed on the conductor of the aluminum wire.

6. The joint method as claimed in claim 5, wherein an outside diameter of the conductor of the aluminum wire is set to be larger than an outside diameter of the conductor of the copper wire.

7. The joint method as claimed in claim 6, wherein serrations are formed on inner face, involving the upper face of the bottom plate, of the conductor press-fitting part which is press-fitted to the conductor of the aluminum wire.

8. The joint method as claimed in claim 5, wherein serrations are formed on inner face, involving the upper face of the bottom plate, of the conductor press-fitting part which is press-fitted to the conductor of the aluminum wire.

* * * * *